United States Patent [19]

Cline et al.

[11] 4,238,442

[45] Dec. 9, 1980

[54] PROCESS FOR MELT SPINNING ACRYLONITRILE POLYMER HYDRATES

[75] Inventors: Edward T. Cline, Wilmington; Francis B. Cramer, Newark, both of Del.

[73] Assignee: E. I. Du Pont de Nemours and Company, Wilmington, Del.

[21] Appl. No.: 379

[22] Filed: Dec. 29, 1978

[51] Int. Cl.[3] ..... D01D 5/04

[52] U.S. Cl. ..... 264/206; 260/29.6 AN; 264/211; 525/336; 525/380

[58] Field of Search ..... 264/182, 206; 260/29.6 AN; 526/214, 224; 525/336, 350

[56] References Cited

U.S. PATENT DOCUMENTS

| | | | |
|---|---|---|---|
| 2,434,054 | 1/1948 | Roedel | 526/214 |
| 3,380,949 | 4/1968 | Isley et al. | 260/30.4 |
| 3,448,092 | 6/1969 | Chiang | 260/79.3 |
| 3,774,387 | 11/1973 | Woodell | 57/140 J |
| 3,819,762 | 6/1974 | Howe | 260/876 |
| 3,828,013 | 8/1974 | Nield | 260/85.5 |
| 3,879,360 | 4/1975 | Patron et al. | 526/224 |
| 3,984,601 | 10/1976 | Blickenstaff | 264/206 |
| 4,004,072 | 1/1977 | Tamura | 526/214 |
| 4,055,532 | 10/1977 | Thompson | 260/29.6 AN |

OTHER PUBLICATIONS

Kirby et al., "Macromolecules", 1, pp. 53–58, (1968).

*Primary Examiner*—Jay H. Woo

[57] ABSTRACT

The melt spinning of acrylonitrile polymer hydrates is improved when the polymer used contains at least 91% by weight acrylonitrile units and up to 9% by weight of one or more copolymeric units and has an intrinsic viscosity of 0.6–2, 7–23 μeq./g. enolizable groups after mild acid treatment, 15–70 μeq./g. thioether ends derived from a water insoluble mercaptan and less than 3 μeq./g. oxidizable hydrolysis fragments.

4 Claims, No Drawings

PROCESS FOR MELT SPINNING ACRYLONITRILE POLYMER HYDRATES

BACKGROUND OF THE INVENTION

This invention relates to an improved process for spinning acrylic fibers by melt extrusion of acrylonitrile polymer hydrates. The resulting fibers have improved initial whiteness as well as improved whiteness retention on heating.

U.S. Pat. No. 3,984,601 (Blickenstaff) teaches preparation of acrylonitrile polymer fibers by melt extrusion of substantially single phase compositions which are substantially partial or complete hydrates of the acrylonitrile polymer. Hydration occurs only within a certain elevated temperature range and under at least autogenous pressure. Extrusion temperatures range from 25° C. below to 10° C. above the temperature of hydration. Acrylic fibers are usually spun as hydrates by extruding at 165°–205° C. At these temperatures there is a tendency for the acrylic polymers to discolor, hydrolyze and degrade. Further, the hydrate melts of acrylic polymers are highly viscous and tend to exhibit "melt fracture" on extrusion. This is believed to be due to elastic deformation as the melt is forced through an orifice and is encountered in melt extrusion of other polymers which tend to have elastic character in the melt. "Melt fracture" can lead to reduced tenacity and breaking elongation of the filaments or a breakdown in spinning. The simplest way to avoid this problem is to increase the temperature. This is unsatisfactory, however, because higher temperatures lead to more rapid discoloration (yellowing) of the fiber and can also introduce an excessive number of voids into the fiber. Another way to avoid the problem is to lower the molecular weight of the acrylic polymer. This is also unsatisfactory because a decrease in molecular weight sufficient to give a substantial reduction in hydrate melt viscosity is accompanied by a large increase in the rate of yellowing of the acrylic polymer.

Polymers for the preparation of acrylic fibers, which by definition contain 85% or more by weight acrylonitrile, are ordinarily prepared as an aqueous slurry using redox catalysts, e.g., potassium persulfate initiator and sodium bisulfite activator. In fiber form, these polymers have the disadvantage of being somewhat off-white in color as formed and discolor even further on heating at high temperatures. It is known that initial yellowness (lack of whiteness) and the tendency to discolor further on heating of the acrylic polymers is inversely related to the polymer molecular weight. Therefore, manufacturing practice has been to adjust polymer molecular weight to that required to provide fibers of acceptable whiteness. The use of higher molecular weight polymer than is needed to provide adequate fiber physical properties results in a loss of productivity since the solutions used in processing such polymers have higher viscosities than would otherwise be needed.

While the source of yellowness is acrylonitrile polymers and fibers prepared therefrom is not completely understood, it is now generally accepted that the color is due to a chromophoric structure consisting of a series of condensed naphthyridine rings each bearing a

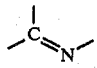

residue, several of which in an unbroken series absorb in the ultraviolet region of the spectrum, rendering the polymer yellow.

One method proposed for blocking formation of this chromophore is to prepare copolymers wherein the acrylonitrile units are separated by copolymeric units sufficiently often to prevent aggregation of the six or seven consecutive acrylonitrile units required for color formation. While effective, this method is generally not useful in the case of fibers because the amount of comonomer required, e.g., about 21% by weight in the case of methyl acrylate, is not conducive to good fiber properties, especially with respect to dimensional stability. Bulky comonomers are more effective on a weight percent basis in preventing formation of the chromophore but are equally disadvantageous with respect to dimensional stability. For example, as little as 10.5 weight percent styrene copolymerized with 89.5% by weight acrylonitrile results in significant shrinkage of fibers prepared therefrom under the hot-wet conditions encountered in commercial dyeing and laundering. Most commercial acrylic fibers contain no more than 9% by weight comonomer(s).

It has recently been proposed by Brandrup, Peebles et al., *Makromol. Chem.*, 98, 189 (1966) and *Macromolecules*, 1, 53–8 (1968) that the naphthyridine chromophores are formed from β-ketonitrile groups derived from an adduct formed by free radical attack on the nitrile groups in the polymer. U.S. Pat. No. 3,448,092 (Chiang) describes a polymerization process using coordination catalysts which provides acrylonitrile polymers having less than 5 μeq./g. β-ketonitrile groups. These polymers have improved stability to discoloration on heating. However, this process is disadvantageous because non-aqueous solvents must be used.

U.S. Pat. No. 3,828,013 (Nield) describes an emulsion polymerization process for preparing acrylonitrile polymers containing up to 95 mol percent acrylonitrile (90.6% acrylonitrile by weight when copolymerized with styrene) using a combination of low volatility and high volatility mercaptans as chain transfer agents to control molecular weight. Although primarily intended for the molding of bottles, the polymers are also said to be suitable for the preparation of fibers. Color stability of the polymers on heating is not mentioned.

Another emulsion polymerization process for the preparation of acrylonitrile polymers is described in U.S. Pat. No. 3,819,762 (Howe). Dodecyl mercaptan is used as a chain transfer agent in some of the examples but is not required by the claims. The resulting polymers containing up to 85% by weight acrylonitrile are suitable for molding into bottles. No suggestion is made that the polymers are suitable for the spinning of fibers.

The present invention provides an improved process for the preparation of acrylic fibers having the process advantages of reduced melt viscosity, reduced sensitivity to discoloration resulting from process interruptions and improved hydrolytic stability. The resulting fibers have improved initial whiteness and improved whiteness retention on heating.

This invention provides an improved process for spinning acrylonitrile polymer filaments comprising addition to the polymer of water in an amount equivalent as a minimum to either 45% of that required to hydrate all the nitrile groups in the polymer or 80% of that required to hydrate the coupled nitrile groups (on a 1/1 water molecule/nitrile group basis), whichever is larger, and as a maximum the amount of water actually combined as hydrate plus 7 weight percent based on polymer, the total water not exceeding the amount necessary to hydrate all the nitrile groups in the polymer, heating the composition under at least autogenous pressure at a temperature ranging between about 25° C. less to about 10° C. more than the temperature of hydration as determined by Laser Raman Spectroscopy and extrusion of the resulting composition under pressure through an orifice to form a shaped product, wherein an acrylic polymer is used containing at least 91% by weight acrylonitrile units and up to 9% by weight of one or more copolymeric units, having an intrinsic viscosity of 0.6 to 2, 7 to 23 μeq./g. enolizable groups after mild acid treatment, 15 to 70 μeq./g. thioether ends derived from a water insoluble mercaptan and less than 3 μeq./g. oxidizable hydrolysis fragments. Preferably the intrinsic viscosity is 0.8 to 1.5 and most preferably the intrinsic viscosity is 0.9 to 1.1. Preferably the polymer has 30 to 50 μeq./g. thioether ends derived from a water insoluble mercaptan.

Polymer suitable for use in the present invention may be conveniently prepared as an aqueous emulsion using water, the desired monomers, relatively low concentrations of a free radical initiator, a surfactant and a water insoluble mercaptan as chain transfer agent. The resulting latex may be coagulated by any convenient means to facilitate isolation of the polymer.

The initiator may be a persulfate acid or salt such as potassium persulfate, an azo initiator such as azo-bis-(isobutyronitrile), azo-bis-(α,α-dimethylvaleronitrile) or azo-bis(α,α-dimethyl-γ-methoxyvaleronitrile) or a peroxide initiator such as t-butyl peroxyneodecanoate or other free radical initiator known in the art.

Low radical concentration is achieved by using a low initiator concentration and operating at low monomer(s)/$H_2O$ ratio and at temperatures as low as consistent with satisfactory conversion and yield. Usually polymerization in emulsion gives whiter, more stable polymer than polymerization in suspension, probably because the polymer accumulates in the nonaqueous phase and thus is insulated from attack by radicals which are formed in the aqueous phase from the water soluble initiator (persulfate). The dodecyl mercaptan or other thiol chain transfer agent serves a dual function. It controls molecular weight by end-capping growing polymer radicals with hydrogen while initiating another chain with the residual RS.radical. Not only is the hydrogen capped end of the first chain stable but also the thioether end of the new chain is highly stable. Thus the second function is to supply a preponderance of stable ends.

The mercaptan chain transfer agent should be essentially insoluble in water. Aliphatic mercaptans having more than 7 carbon atoms are essentially insoluble in water. Dodecyl mercaptan is preferred. Use of an essentially water insoluble mercaptan made available in the polymerization zone by addition of a mutual solvent or an effective emulsifier tends not only to increase the resistance of the polymer to discoloration but also to compensate for the lower polymerization rate entailed by using a low initiator concentration.

Although dodecyl mercaptan is the preferred chain transfer agent, other oil soluble mercaptans including alkyl or aralkyl mercaptans varying in carbon atoms per molecule from 6 to 20 or more may be used. Other nonreactive groups such as hydroxyls, ethers and esters may be present so long as they do not increase water solubility and decrease oil solubility greatly. A final consideration is that the shorter chain mercaptans of $C_8$ or $C_6$ carbon content typically give lower polymer yields than do longer chain mercaptans.

Suitable surfactants should be nonsubstantive on the polymer, i.e., other than cationic if the polymer is designed to be dyeable with cationic dyes. Approximately 5% by weight or less of this surfactant, based on monomers, should efficiently disperse the monomers and chain transfer agent and provide an emulsion of the polymer that is coagulable yet stable to monomer stripping conditions and storage. Preferably, the surfactant should be removable by washing with water. Alkylphenol polyethyleneoxy sodium sulfates having up to 10 ethyleneoxy groups are preferred. The corresponding phosphates are also useful but are more difficult to remove because of lower solubility in hot water. In most instances, at least 0.5% by weight surfactant is required.

The amount of agitation required to produce the acrylic polymers useful in the present invention depends on the composition of the polymerization medium. If a preferred surfactant is present in sufficient quantities to provide a stable emulsion of the polymer, moderate agitation is sufficient. However, more vigorous agitation is required with use of lesser amounts of surfactant or with use of a less efficient surfactant. A deficiency in agitation can be compensated for in part by an increase in mercaptan content. Likewise, increased agitation tends to reduce the amount of mercaptan required to provide a given molecular weight polymer, other factors being constant.

The polymerization preferably is carried out in the range of 25°–65° C. Use of relatively high temperatures increases the rate of polymerization while reducing the molecular weight of the acrylic polymer. Use of relatively low temperatures has the opposite effect. Use of temperatures below about 25° C. results in polymerization rates too low to be commercially useful while temperatures above 65° C. encourage inefficient initiator decomposition and increase side reactions between the initiator and the mercaptan chain transfer agent.

Polymer may be recovered from emulsions by freezing or coagulation of the latex with salts or acids. Preferably, excess monomers first are stripped off under vacuum to prevent further polymerization and to facilitate coagulation. Salts such as sodium chloride, aluminum sulfate or magnesium sulfate and acids such as hydrochloric, sulfuric or phosphoric acids are useful coagulants. After the coagulant is added to the stripped latex, the mixture is heated until the coagulated particles grow large enough to filter easily.

The term "coupled nitrile groups" refers to those nitrile groups along the chains of acrylonitrile polymer molecules that are coupled by dipole-dipole interaction, i.e., where one nitrile is attracted to, and associates with, the closest nitrile or nitriles. At ordinary temperatures most acrylonitrile polymers exist in a molecular configuration wherein nitrile groups along one molecular chain are coupled with nitrile groups along one or more adjacent molecular chains. If the polymer is a homopolymer of acrylonitrile, substantially all the nitrile groups are coupled or are capable of coupling under conditions which provide adequate mobility to the molecular structure. If the polymer is a random copolymer containing up to about 15% by weight comonomer units, the presence of the copolymerized units hinders the coupling ability of some of the nitrile groups of the acrylonitrile units and thus reduces the number of coupled nitriles. When the copolymer contains more than about 15 weight percent of the more commonly used modifiers such as methyl acrylate or vinyl acetate, substantially all nitrile couplings are hindered by the presence of the comonomer units.

It will become apparent that the foregoing limitations on comonomer-unit content as influencing coupling of nitrile groups can be only approximate as a generality, although, as will be shown, such limitation can be determined with good precision for any given monomer. Hindering of nitrile-nitrile coupling is a function not only of the number (mol-%) of comonomer units present but also of the size of the comonomer side-group. A small side-group such as the chlorine moiety of vinyl chloride, for example, or the absence of any side-group as in ethylene, results in the disturbance of one nitrile-nitrile coupling (due to the absence of a nitrile group at that position). A large group, on the other hand, such as a phenyl, sulfo-phenyl, or halogenated phenyl group, as examples, can sterically hamper coupling over a considerable length of the polymer chain to which it is attached. With comonomers such as methyl acrylate and vinyl acetate, about 15% modification results in disturbance of essentially all nitrile-nitrile coupling, as noted above, and loss of the acrylic polymer characteristics such as infusibility. As much as 30–35% of vinyl chloride can be incorporated into the polymer, however, without complete loss of acrylic-like properties.

The temperature of hydration, $T_h$, is defined as the minimum temperature at which an operative acrylonitrile polymer/water composition becomes a substantially single phase shapable melt, i.e., sufficient hydration to form a melt will occur with that composition. Water in excess of that which will combine at $T_h$ is tolerable within the limits outlined herein. If the hydrate melt obtained contains less combined water than that combined when all nitrile groups are associated in a 1/1 relationship with water molecules, then additional water can be combined, if present, by raising the temperature. Thus, for any polymeric material the operative temperature may be selected over a range.

If the composition has been raised to an operative temperature, a moderate decrease in temperature up to about 25° C. below $T_h$ can be tolerated without loss of shapability, due to hysteresis in the hydration/dehydration cycle. A moderate increase in temperature, up to about 10° C. can be tolerated also, but if excess water is present the formation of additional nitrile group/water associations may thereby result in an altered composition (depending on the relationship between hydration degree and temperature in that temperature range). In general, it has been found preferable to employ a temperature of shaping somewhat lower than $T_h$ and an excess of water within the operable range, as specified.

The shapable, single-phase compositions of this invention are substantially partial or complete hydrates of an acrylonitrile polymer as heretofore defined. They are formed only within a definite range of elevated temperatures.

It has been found that if fewer than 45% of all the nitrile groups of the polymer are hydrated, i.e., associated with water molecules, the composition does not have the fluidity or homogeneity required for acceptable extrusion and drawability of the spun product. It has further been found that if any coupled nitrile groups are present the polymer composition is difficult to extrude if fewer than 80% of the coupled nitriles are hydrated. On the other hand, if water is present in a substantial excess over that capable of hydrating nitrile groups of the polymer at a particular temperature of the composition within the temperature range at which hydration occurs, then the excess water (i.e., water over that amount able to combine with the nitrile groups at the selected temperature) will tend to form a second phase. Minor amounts of such excess water (i.e., up to about 7 weight percent on polymer more than can combine as hydrate at the temperature employed) may be tolerated (a larger excess of water, i.e., about 9–10% excess, may be tolerated if the comonomer units are hydrophilic), but with polymers of acrylonitrile and the more common copolymer modifiers, the maximum water tolerable is that required to hydrate all nitrile groups. It has been found that an excess of water in these ranges is frequently advantageous in the shaping process, since it reduces the viscosity of the hydrate melt, but a gross excess of water is unacceptable; it interferes with extrusion and causes bubbles and shattering of the extrudate, leading to process discontinuities. In general, with polymers containing about 7.5 weight percent or less modification by units of one or more of the more commonly used copolymerizable monomers (such as methyl acrylate or vinyl acetate), the minimum amount of water needed for good shapability will be 80% of that required to hydrate the coupled nitrile groups. Polymers of higher (i.e., over about 7.5 weight percent) modification with units of such monomers usually require as a minimum that amount of water needed to hydrate 45% of the total nitrile groups.

The compositions to be shaped can readily be formed by adding the exact amount of water required to hydrate between as a minimum either 45% of that required to hydrate the coupled nitrile groups (on a 1/1 water molecule/nitrile group basis), whichever is larger, and as a maximum the amount combined as hydrate plus 7 weight-% water based on polymer (observing the limitation not to exceed that amount needed to hydrate all nitrile groups) and heating the mixture under autogenous or higher pressure to the temperature needed to form a substantially single-phase melt (which is indicative of hydrate formation). Alternatively, an excess of water may be added, the composition heated to the desired temperature under autogenous pressure and the excess water removed by either gravity separation (the molten hydrate is heavier than water) or evaporation. After hydrate preparation, the composition will retain its single-phase character at somewhat higher and lower temperatures than that needed for preparation. Thus, the composition once prepared is shapable at a temperature of about 25° C. less to about 10° C. more than the minimum temperature of preparation. Shaping of the composition at a somewhat lower temperature than that needed for preparation of the hydrate accelerates quenching and promotes formation of solid filaments and films.

Shapable compositions cannot be formed by simply adding an amount of water within the required range to the acrylic polymer because the hydrates are formed only at elevated temperatures. The required elevated temperatures can be determined for the acrylic polymer either by visual means or more accurately, in many cases, by Laser Ramam Spectroscopy, both as taught in U.S. Pat. No. 3,984,601.

The amount of water required to form substantially single phase shapable compositions can be determined by differential thermal analysis as taught in U.S. Pat. No. 3,984,601.

If a temperature in the lower part of the operable range is used for shaping of a composition having a degree of hydration of the polymer near the minimum required, then it is preferable to use a polymer of lower inherent viscosity than would be used at shaping temperatures in the higher part of the range for compositions in which the amount of water present is near the maximum permissible.

On extrusion, there may be some tendency for bubbles to appear in the extruded structure. The formation of such bubbles can be minimized by forced cooling of the emerging shaped structure or by use of pressure around the extrudate for a short time after extrusion. Deaerating the composition prior to extrusion is also useful. The deaeration can be carried out either by freezing the composition and evacuating the container, then reheating, or by processing the composition in a suitable screw-type extruder.

The single-phase hydrate compositions have sufficient stability under autogenous or higher pressures and at temperatures in the range discussed above to be extruded.

The fibers produced by the process of the present invention are filaments characterized by a sheath surrounding a core in which the sheath has a positive gradation in density, i.e., the density increases toward the surface of the filament. All the filaments of this invention contain the sheath, which has a thickness of about 5% to 50% of the distance from the outer surface to the axis of the filament, and which exhibits the positive gradation in density from a low near the sheath/core boundary to a high at the surface of the filament. Such a structure confers high bending modulus and bulk to the filaments of this invention and leads to surface striations on drawing which gives a dry hand and, in aggregates of these filaments promotes high water-absorption rates.

The density gradient in the sheath is believed due at least partly to the presence of a multitude of submicroscopic voids that are more densely concentrated toward the core of the filament than they are toward the outer surface. The voids in the sheath are too small to be seen by optical or the usual scanning electron microscopic techniques, i.e., smaller than about 0.05 micron in diameter, but they are detectable by transmission electron microscopy at magnification of 70,000X or more. The gradient amounts to a density drop of at least about 0.001 g/cc per 10% by weight of fiber removed from the outermost portion of the filament.

As the filaments of this invention are spun, they develop voids in a core portion of the filament, which appear to be closed-cells as observed under microscopic examination. The void concentration is between about $10^5$ and $10^7$/mm.$^2$ of core cross-section and the voids range in diameter from those barely resolved (having a diameter of about 0.05 micron) in a scanning-electron micrograph to a maximum of about 1 micron. These voids which are seen in scanning-electron micrographs are sometimes referred to herein as "optical voids". These void-containing filaments can be heat-annealed after drawing to "heal" the "optical voids", but what appear to be vestiges of the voids are detectable by transmission electron microscopy at higher modifications. They are also inferred from light scattering data.

When any of the as-spun filaments of this invention, whether voided-core or annealed, are drawn to about 200% or more of their as-spun length, the skin of the filament develops multiple striations along the longitudinal axis of the filament. Each striation has a depth between about 0.2 and 2.0 microns, a length of between about 15 and 500 microns and the striation count is from about 6 to 20. The skin can be up to about 5 microns thick. It is believed that the striations develop in this skin portion of the sheath because the skin is highly oriented, denser and, therefore, less drawable than the remainder of the sheath or the core. The striations are believed to contribute to the superior dyeability of the drawn filaments of this invention relative to the undrawn. The drawn filaments dye about as well as art-known acrylonitrile-polymer filaments even though the dense skin of the filaments of this invention would be expected to act as a substantial barrier to dyes. The striations are also believed responsible for the ability of aggregates of these drawn filaments to transport, i.e., absorb, water at a rate several times that of filaments comprising the same acrylonitrile polymer that have been wet or dry spun by conventional dry or wet spinning.

The drawn filaments can also be annealed, i.e., wetted and heated at a temperature of about 170° to 200° C., to "heal" the optical voids in the filament. The annealed filaments still retain the positive density gradient and the diffuse luster which is taken as an indication that submicroscopic voids (i.e., voids less than 0.05 micron in diameter) or their light-scattering vestiges are still present in the filament.

Filaments of 1000 denier or more can be prepared by the procedures of this invention as well as the more ordinary textile-denier filaments.

The shaping of the substantially single-phase compositions of this invention is unique in several respects. One of the more striking characteristics is seen as the nearly instantaneous solidification of the extrudate. It is evident that there is virtually no tendency for extruded filaments to collapse toward the "natural", round cross-section. Consequently, filaments shaped from the compositions have cross-sectional dimensions of the spinneret capillaries used to shape them. One advantage of such instantaneous solidification lies in the capability to produce filaments of certain shapes which are impossible or difficult to produce by usual melt, wet- or dry-spinning means. A further advantage of the instantaneous solidification of extrudate is seen in the complete absence of fused or "twinned" filaments. The slower solidification of extrudate in processes heretofore known has required wider spacing of capillaries in the spinneret, and careful control of cooling or evaporative gas flow, to avoid merging of streams of extrudate or "twinning". Such limitations are virtually absent in shaping compositions of this invention.

TEST PROCEDURES

Enolizable Groups $\beta$-ketonitrile groups are believed to be present in all free-radical-produced acrylonitrile polymers. They are formed during polymerization by attack of a radical on a nitrile group in a preformed or growing molecule, giving an enamine group. Subsequent hydrolysis leads to a $\beta$-ketonitrile group. The accepted reactions are outlined in both U.S. Pat. No. 3,448,092 and Macromolecules 1, 59 (1968). Such groups exist in two forms, keto and enol, that are in equilibrium with each other:

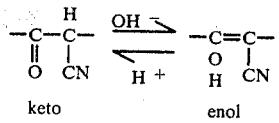

The procedure by which enolizable groups are measured in acrylonitrile polymers or fibers comprises mild acid treatment to insure conversion of all enamine groups to ketonitrile groups and titration by base, using a UV absorbance maximum found in the range of 270–275 nm as indicator. A faster method is based on UV absorbance alone, once a calibration of the absorbance difference has been done. The procedure is:

1. One gram of 50-mesh or finer polymer (or fiber) is stirred at the boil for one hour in 100 ml. water previously adjusted to 2.0 pH with hydrochloric acid. The mixture is cooled to room temperature and its pH is adjusted to 4 with dilute sodium bicarbonate. The polymer (or fiber) is removed by filtration, washed on the filter with 5 50-ml portions of water and vacuum dried at 50°–60° C. to constant weight.

2. About 0.16 g weighed to the nearest 0.1 mg. of the acidified and dried polymer (or fiber) is dissolved by stirring at room temperature in 40 ml. of a solution of one part propylene carbonate dissolved in three parts (by weight) of ethylene carbonate (EC/PC), the solvent previously having been stirred for about 30 hours in activated carbon and filtered. The solution is acidified to an apparent pH of 0 by addition of about 10 μeq. perchloric acid (0.1N in methanol). The solution is divided into two 20 ml. portions.

3. One portion of the solution is used to fill a 1-cm cell, retaining the residue; absorbance is measured while scanning on a UV split-beam spectrophotometer from 350 to 250 nm to define exact location and intensity of absorbance at the maximum (in the vicinity of 270 nm). A 20-ml sample of solvent, to which the identical amount of perchloric acid has been added, is used to fill the reference cell, again retaining the residue.

4. To the second 20-ml portion about 25 μeq. of potassium hydroxide (0.1 N) in ethanol is added to give an apparent pH of about 11; the same amount of base is added to the reference.

5. The absorbance scan is repeated. The difference in absorbance intensities at the maximum is directly related to the amount of enolizable groups in the polymer (or fiber) sample.

6. Calibration of the absorbance in terms of enolizable groups is done by making a series of absorption scans on a solution of 1.0 g. polymer, weighed to the nearest 0.1 mg., in 50 cc EC/PC, first as described in steps 1–3 above, then (repetitively) after each of several additions of small known amounts of 0.05 N potassium hydroxide in ethanol until the final scan of the solution at an apparent pH of about 11. The absorbance intensities at maximum for the several scans are plotted, as a function of μeq. of base added after correction for dilution by the KOH solution. The straight-line portion of the plot provides the relationship between μeq. of base (and thus μeq. of enolizable groups) and absorbance difference.

Thioether Ends

Thioether end-group content is measured as the difference between strongly acidic, sulfur-containing groups and total combined sulfur. The steps involved are (1) removal of any monomeric, sulfur-containing contaminants, such as occluded dodecylmercaptan and any addition product of the mercaptan and a monomer, (2) dyeing with crystal violet and measuring the equivalents of dye taken up and (3) determination of the total sulfur. The procedure is:

1. 5 g polymer is dissolved in 100 ml DMF by cooling the DMF to 0°–5° C., dispersing the polymer therein and heating with agitation to about 50° C.

2. The solution is poured slowly into the vortex of 450 ml water being rapidly stirred in a blender. About 25 g sodium chloride is added to coagulate (precipitate) any soluble fraction, and stirring is continued for three minutes.

3. The suspension is poured into a beaker and heated to 70° C. It is cooled to about room temperature, filtered and washed on the filter with deionized water until the filtrate is found to develop no silver chloride precipitate on addition of silver nitrate.

4. The polymer is allowed to dry in air, then is ground in a mortar and stirred in 100 ml methanol at 55° C. for 30 minutes. The suspension is filtered; the residue is washed with methanol and vacuum-dried to constant weight.

5. The purified polymer is ground in a "Freezer Mill", using liquid nitrogen as coolant, to pass a 200-mesh screen.

6. About 0.25 g of the ground polymer (weighed to the nearest milligram) is transferred to a vial containing 2.5 mg. sodium acetate, 10 ml. 0.5% aqueous solution of crystal violet and 15 ml. water. The pH is adjusted to 4.5 with 1% acetic acid solution. The vial is capped, the cap secured with Teflon ® tape, and the vial heated for 3 hours in a boiling water bath with occasional shaking. The vial is cooled and 5 ml. 10% sodium chloride mixed with the contents.

7. The dyed polymer is filtered off using a Type-A, 1-micron glass filter pad, washed on the filter successively with 50/50 acetic acid/water, water and, finally, ethanol, in each case until the filtrate is colorless. The residue is dried for 20 min. in a vacuum oven at 60° C.

8. About 0.015 g of the dyed, washed and dried polymer is weighed to the nearest 0.0001 g. and transferred to a 100-ml volumetric flask. Dimethyl sulfoxide (DMSO) and 2 ml acetic acid are added, and nitrogen blown through until the polymer dissolved. The flask is filled to the mark with DMSO.

9. Absorbancies are measured at once at 690 nm (background) and at the crystal violet peak near 595 nm. The difference is net absorbance; from it μeq. strong-acid sulfur (dyesite) is calculated, using a calibration plot of net absorbancies vs. known concentrations of crystal violet, correcting for weight of dye in the sample.

Total sulfur is determined by oxidation of a sample of the purified polymer under conditions that result in conversion of all sulfur to sulfate and titration with barium perchlorate; the steps are:

An amount of polymer (generally 250 mg. or less) calculated to contain 0.4–8 mg. sulfur is weighed to the nearest 0.001 g and burned in an oxygen flask to convert all sulfur to trioxide which is absorbed in a sodium carbonate solution previously added to the flask.

The sulfate solution is titrated with standardized barium perchlorate solution using the Thorin Alphazurine Blue end point. The barium solution is prepared by dissolving 0.05 moles barium perchlorate in 200 ml water and adding 800 ml ethanol. The solution is adjusted to an apparent pH within the range of 2.5–4 with dilute perchloric acid and standardized with standardized sulfuric acid, using the same indicator as to be used in the sulfate titration.

Oxidizable Hydrolysis Fragments

Oxidizable hydrolysis fragments are measured by alkaline hydrolysis of a polymer sample and titration with iodine. The procedure is:

1. About 2 g of polymer (or fiber), weighed to the nearest 0.0001 g, is stirred for three hours in 100 ml of 1.5% sodium hydroxide solution under reflux. During this treatment the suspension thickens and discolors, then thins and clears.

2. The resulting solution is cooled to room temperature and acidified to pH 2 with sulfuric acid, which results in a taffy-like precipitate. The mixture is again cooled to room temperature.

3. A starch indicator is added, and the mixture is titrated with 0.02 N iodine solution, using good agitation, until a blue color persists for one minute.

Intrinsic Viscosity is the limit of the natural logarithm of the ratio of the flow time of a dilute solution of a polymer to solvent flow time as the polymer concentration approaches zero. The solvent is a 0.2-molar solution of lithium bromide in dimethylformamide. The temperature at which the measurements are made is 25° C.

Hydrolytic Stability

Polymers of this invention are also characterized by a high resistance to hydrolysis by water at high temperature. This is important to processes such as taught in U.S. Pat. 3,984,601—shaping from a single-phase hydrate.

To measure hydrate stability, samples of finely ground polymer are sealed in glass tubes with ⅓ their weights of water and heated for varying periods of time at 180° C. On termination of its particular period of heating, each tube is cooled in dry ice, and immersed quickly in water; the suspension titrated to determine the amount of ammonia liberated. The onset of hydrolysis is taken as the time in hours at 180° C. for ammonia evolution to amount to 0.05 meg./g polymer.

It is important, of course, to assure the absence of alkaline materials in the polymer to be tested. This can be done by a preliminary treatment as in Step 1 of the above procedure for determining enolizable groups or by treatment with volatile acid such as a dilute solution of acetic acid, followed by thorough rinsing and drying.

Color

Yarn is evaluated for whiteness after winding on a metal card having a 7.6 cm hole in its center. The yarn is wound evenly on the card so as to cover the hole completely. Measurements are made on a Hunterlab Color and Color Difference Meter, Model D-25, using as a standard of comparison a Hunter standard white, MgO, plate.

L measures lightness and varies from 100 for perfect white to zero for black, approximately as the eye would evaluate it. The chromaticity dimension a measures redness when plus, gray when zero and greenness when minus. b measures yellowness when plus, gray when zero and blueness when minus.

Whiteness, or "W", values are provided by the D25W module when used with a Model D-25 Hunterlab Color and Color Difference meter. In this measurement, W=4.Blue-3.Green, emphasizing (reading as higher values) the blue reflectance, which correlates with the visual impression of whiteness and deemphasizing (reading as a decrease numerically) the yellowness reflectance. Details of the method for all tristimulus coordinates are given in the D-25 brochure published by Hunter Associates Laboratory, Inc., Fairfax, VA.

DMF Color Stability

In the process of dry spinning, the polymer is dissolved in a volatile organic solvent and extruded into an evaporative atmosphere. One of the preferred solvents is dimethyl formamide (DMF), which will accommodate a practical amount of polymer, but only at relatively high temperatures. Whiteness durability to extended periods of exposure to high temperature in DMF is an important characteristic of a polymer to be spun to fiber. In the test termed herein "DMFCS", a 2% solution of the polymer in DMF is heated under nitrogen for 3 hours at 130° C., cooled, and its absorbance at 425 nm measured. The values reported in the table are absorptivity, calculated as $$\left(\frac{\text{absorbance}}{C \cdot L}\right) \cdot 100,$$

in which absorbance is the difference between that measured on a sample which has not been heated and that measured after heating the solution 3 hours at 130° C., C is the concentration of polymer in the solution in grams/liter and L is the optical length of sample used to measure absorbance. The resultant is arbitrarily multiplied by 100 in order to obtain more convenient values for comparative purposes.

In the following examples, parts and percentages are by weight unless otherwise specified.

Polymer Preparation

I. Polymer According to the Invention

This illustrates some of the process variations that may be employed in the manufacture of acrylonitrile polymers for use in this invention.

The following Tables summarize 9 polymer runs. In the Tables, AN is acrylonitrile; MA is methyl acrylate; SSS is sodium styrenesulfonate; MMA is methyl methacrylate; AMPS is acrylamido-2-methyl propanesulfonic acid; SSA is styrenesulfonic acid; "Ultrawet 99LS" is a dodecylbenzenesulfonate surfactant sold by ARCO; "Gafac RE 610" is a nonylphenoxypoly (ethyleneoxy) phosphoric acid surfactant sold by G.A.F.: "Alkanol WXN" is a dodecylbenzenesulfonate surfactant sold by Du Pont; PVA is a polyvinyl alcohol; MeCel is methyl cellulose; and LM is lauryl mercaptan (n-dodecylmercaptan).

The process employed for Run I. as described below is generally the same as for those employed in Runs II, III, VI and VII. Variations in the preparation of these latter polymers are given in the Table.

This illustrates the preparation of a copolymer containing 92.2% by weight acrylonitrile, 7.3% by weight methyl acrylate and 0.5% by weight sodium styrene sulfonate.

Water (5976 kg.), sodium dodecylbenzene sulfonate ("Ultrawet" 99LS, 10.8 kg.) and sodium styrenesulfonate (5.26 kg.) are mixed at room temperature in a nitrogen blanketed (pressure=14–34 kPa), glass-lined 7570 liter kettle. The pH is adjusted to 7.1 with NaOH and the mixture heated to 50°–56° C. This is solution (1).

Acrylonitrile (964.8 kg.) and n-dodecylmercaptan (10.4 kg.) are mixed in a nitrogen blanketed kettle similar to that used above. This is solution (2).

Solutions (1) and (2) are blended at the inlet of a centrifugal transfer pump at the rate of 227 l./min. in a volume ratio of 6.3/1, respectively. A second centrifugal pump of smaller capacity than the first is piped backwards into the discharge of the first to provide additional turbulence. The resulting emulsion is fed into a jacketed polymerization reactor of 7570 liters capacity with agitation under a nitrogen blanket of 14 kPa while methyl acrylate (76.2 kg.) is added and the temperature raised to 59.5° C. over a 30 minute period.

The polymerization is initiated by adding an aqueous solution containing 820 g potassium persulfate. Polymerization is continued for five hours at 60°±1° C. The resulting latex is steam stripped at 55°-65° C. and 130-170 mm Hg. absolute to remove unreacted monomer. The latex is cooled to 30°-35° C. and continuously coagulated in two 284 liter vessels in series. Each vessel is equipped with a 20.32 cm, 2.54 cm. pitch propeller for agitation and is blanketed with nitrogen at 172 kPa. The propeller in the first vessel is operated at 1140 rpm and the propeller in the second at 300 rpm. The latex is pumped into the first vessel at 11.4 l/min along with an equal volume of water and 0.4 l/min 0.5% by weight aqueous $MgSO_4$ as coagulant. The coagulum flows from the first vessel to the second vessel where the polymer particles agglomerate to filterable size. The temperature of the first vessel is 70° C. and that of the second is 125° C.

The polymer is removed by filtration and washed and dewatered on a continuous belt filter 45.7 cm. wide and 4 m. long running at 6.4 m/min. Cake forming utilizes 51 cm. of belt length followed by two washing zones 61 cm in length and a steaming zone 76 cm in length. The final 1.5 m. of length is used for dewatering to a polymer content of 26%. 2380 parts by weight water at 95° C. and 35.7 parts by weight steam and used per 100 parts per weight polymers.

The polymer is dried batch-wise to less than 2% by weight moisture in a rotating, double-cone vacuum dryer at first jacketed with 76°-88° C. water and then with 14-21 kPa steam in the later stages.

IV and VIII.

Preparation of polymers IV and VIII is closely analogous. The description following is of the preparation of the polymer IV. Variations in polymer VIII and its preparation are given in the Table.

This example illustrates continuous emulsion polymerization.

The apparatus used includes two reactors in series. The overflow from the first reactor flows into the second reactor. Both reactors are continuously fed reagents, as detailed below, and the polymer emulsion overflows continuously from the second reactor. Both reactors are equipped with 4 approximately 2-cm vertical indentations or ribs to damp swirling and enhance mixing and have jackets for water heating and cooling. Working capacities of the first and second reactors are 2.4 l and 12.8 l, respectively.

Feeds for the first reactor are emulsified in a first premixer which consists of a 500 cc 3-neck flask equipped with a stirrer having four blades 1 inch (2.54 cm) long and 0.25 inch (0.64 cm) wide operating at 2300 rpm. Feeds for the second reactor consist of the overflow from the first reactor and additional feeds, as detailed below, emulsified in a second premixer which consists of a 1000 cc, 3-neck flask equipped with a stirrer similar to that of the first premixer. The entire system is maintained under a nitrogen blanket.

The reactors are swept well with nitrogen, charged with the following ingredients just prior to start up and heated to about 65° C. by circulation of hot water in the jackets of the reactors.

| | Prefeed to Reactors | |
|---|---|---|
| | 1st Reactor | 2nd Reactor |
| Water | 1200 g | 6400 g |
| $K_2S_2O_8$ | 0.30 g | 2.23 g |
| Emulsifier-nonyl phenol poly(ethylene oxy) phosphate ("Gafac" RE 610) | 12.05 g | 45.6 g |
| pH (adj. with $NH_4OH$) | 5.2 | 4.15 |

At startup, the following continuous feeds are begun to the inlets of the first and second premixers, respectively, which previously had been half filled with the same compositions less monomers and initiator:

| | Feed rates per minute | | | |
|---|---|---|---|---|
| | 1st Premixer | | 2nd Premixer | |
| Acrylonitrile (AN) | 15.64 g | | 22.54 g | |
| Methyl acrylate (MA) | 1.34 g | | 2.01 g | |
| dodecylmercaptan | 0.064 g | (with AN) | 0.143 g | (with AN) |
| sodium styrenesulfonate | 0.085 g | (as 27 cc aqueous) | 0.133 g | (as 10.9 cc) |
| Gafac RE 610 | 0.572 g | | 0.186 g | |
| $K_2S_2O_8$ | 0.02 g | (as 5 cc aqueous) | 0.019 g | (as 1.55 cc aqueous |
| Water | 4.3 g | | 6.36 g | |

With these feed rates, holdup in reactor 1 is about 42 min. Holdup in reactor 2 is about 120 min. After start of the polymerization, reaction temperatures are maintained at 65°±0.5° C. by controlling the temperature of cooling water fed to the jackets.

Periodic samples of the emulsion that continuously overflows from the second reactor are coagulated at once, and the polymer removed by filtration washed, dried and weighed to determine conversion rate.

The overflowing emulsion from the second reactor is stripped to a monomer content of 120 ppm or less by first gently agitating while evacuating to a pressure of about 660 mm Hg, diluting with water to about 36% polymer content and countercurrent stripping in a packed column with steam.

Characterization data in Table II for these polymers (IV and VIII) were derived from plexifilaments produced from the polymer emulsion in the manner as generally described by U.S. Pat. No. 3,774,387, except that no clay or other surface active additive was employed in shaping.

V. Conventional Redox Polymer

The two items described under this heading in the Table were made in a commercial-scale, prior-art, redox, slurry polymerization process such as taught in U.S. Pat. No. 2,837,501, and are included as comparisons.

Semi-dull (0.4% $TiO_2$ delusterant) yarns made by art-known dry spinning process from polymers II, III, V-A, V-B and VI-VIII were knitted and the fabrics boiled for one hour in 0.1% NaOH solution to simulate the discoloration effect of severe commercial laundering. After thorough rinsing and drying, they exhibited yellowness corresponding to the "b" values in Table II. Enolizable groups content of the polymers are also included in Table II and a comparison between these values for the various polymers illustrates the correlation between them. Other characterization data in the table which in general correlate with enolizable group content are hydrolytic stability (HS) and DMF color stability (DMFCS); the latter is a measure of whiteness stability on exposure of a solution to high temperature.

It is apparent from the tabulated data that the polymers and the fibers made from them by the process of this invention are superior in whiteness not only initially but after use. The data in the "Simulated Severe Laundering" column illustrate the durability-of-whiteness advantage for several of the polymers useful in practice of the invention in comparison with two prior art polymers. Although such data are not available to illustrate adequacy of some of the tabulated polymers in this respect, it is the inventor's belief that all polymers within the scope of the characterizing limitations as described herein possess these advantages.

DMFCS, while of more practical concern in the manufacture of fiber of good initial whiteness, nonetheless reflects the advantage of improved whiteness durability of polymer during the high-temperature exposure involved in shaping.

TABLE I

| Run No. | Emulsifier (% on Monomer) | Initiator (% on Monomer) | T/React. Time °C./hrs. | Chain Terminator (% on Monomer) | Conversion (%) | Polymerization Type |
|---|---|---|---|---|---|---|
| I | Ultrawet 99LS (1) | $K_2S_2O_8$ (0.08) | 60/5 | LM (1.01) | 75 | Batch |
| II | "Alkanol" WXN (3) | $K_2S_2O_8$ (0.15) | 60–70/3 | LM (0.86) | 65 | Batch |
| III | Gafac RE610 (4) | $K_2S_2O_8$ (0.1) | 67/0.5 | LM (0.7) | 30 | Continuous |
| IV | Gafac RE610 (1.8) | $K_2S_2O_8$ (0.09) | 65°/2 | LM (0.5) | 83 | Continuous |
| V-A. V-B | None | $K_2S_2O_8$/ $NaHSO_3$ .31/2.5 | 60/62 min. | none | 80 | Continuous |
| VI | Gafac RE610 (2.5) | $K_2S_2O_8$ (.031) | 60/5 | LM (0.94) | 80 | Batch |
| VII | PVA (0.26) Methocel (0.38) | Vazo® 52 (0.25) | 60/3 | LM (1.26) | 78 | Batch |
| VIII | Gafac RE610 (3) | $K_2S_2O_8$ (0.2) | 65/1.5 | LM (0.7) | 86 | Continuous |

TABLE II

| Run No. | Polymer Feed Comp.(%) | [η] | EG (μeq/g) | TE (μeq/g) | OHF (μeq/g) | HS (hrs.) | Fiber Whiteness (boiled off) (b/L/W) | DMFCS | Simulated Sever Laundering "b" |
|---|---|---|---|---|---|---|---|---|---|
| I | AN/MA/SSS (92.2/7.3/0.5) | 0.93 | 16 | 45 | 1.8 | 7 | 2.2/85/62 | .12 | |
| II | AN (100) | 1.5 | 9 | 50 | 1 | 9.2 | −0.2/86/74 | .07 | 3 |
| III | AN/MA/SSS (93.7/5.6/0.7) | 1.0 | 19 | 34 | 1 | 6.4 | 3.1/90/- | — | — |
| IV | AN/MA/SSS 91.5/8.0/0.5 | 1.32 | 14 | 18 | 1.5 | 6.5 | 3.0/97/77 5/87/48 | | |
| V-A | AN/MA/SSS | 1.0 | 35 | none | 18 | 3.5 | 5.7/94/56 | .83 | 13.1 |
| V-B | 93.9/6/0.1 | 1.4 | 27 | none | 17 | 4.5 | 5.7/94/56 | .35 | 7.8 |
| VI | AN/MA/SSS | 0.96 | 14 | 44 | 1.5 | 7 | 1.6/94/50 | .13 | 1.9 |
| VII | AN/MA/t-BuA-SS 90.7/7.8/1.5* (91.3/7.9/0.8) | 0.82 | 11 | 61 | 1 | 6.5 | 3.1/90/65 | — | — |
| VIII | AN/MA/SSS 91/8/1 | 1.1 | 17 | 30 | 1 | 8 | 2.3/95/78 | .14 | 1.8 |

*As sodium salt of SSA; made as the triamylamine salt; becomes the sodium salt on scouring.

EXAMPLE I

The polymer of run number VII is formed into small briquettes by prior art means to facilitate vibratory screw metering and fed at 35 g./min. into a twin-screw extruder such as a Werner & Pfleiderer Model ZDS-K28 co-rotating twin-screw devolatilizing extruder. The extruder is assembled in five zones: a feed zone, two water cooled zones and three heated zones. Dry polymer is fed into the feed zone and compacted therein to form a seal. Water at 8.8 g./min. and 2-pyrrolidone at 2.3 g./min. are injected into the second zone of the extruder to form an intimate mixture with the polymer, which is subsequently melted to a substantially single-phase hydrate as the temperature is raised to 136° C. in zone 3, 156° C. in zone 4, 179° C. in zone 5 and 185° C. at a spinneret coupled through a metering pump to the discharge end of the extruder. The hydrate is extruded at 43.8 g./min. through the spinneret which has 45–0.15 mm diameter, 0.51 mm long holes. After passage through an annealer filled with saturated steam at 193 KPa (28 psig.) the colorless yarn is wound up at 192 m./min. The yarn has L, a, b, W values of 90, −0.5, +3.1 and 65, respectively.

EXAMPLE II

This example illustrates the improved hydrolytic stability of the acrylic polymers useful in the present invention.

The polymer tested is the polymer of Run III and the control polymer is a polymer similar to the polymer of Run V-A. The procedure is as follows:

1. Thirty grams of finely ground polymer is thoroughly mixed with 7.7 g water and 2 g tetramethylene sulfone at room temperature.

2. The mixture, which appears to be a dry powder, is transferred to a heavy walled cylinder equipped with one screen having about 20 wires/cm. and two screens having about 79 wires/cm. and a spinneret with a single hole 0.25 mm in both diameter and length.

3. A closely fitting, Teflon®-gasketed, free piston is inserted. The spinneret is closed by pressing a Teflon® pad against its outer face.

4. The cylinder is cooled to −10° C. and evacuated via a valved side port between the piston and the spinneret to a pressure corresponding to the water vapor pressure at that temperature. The side-port is closed.

5. The cylinder is heated to 180° C., pressured with about 3500–4100 KPa (500–600 psig) nitrogen applied to the piston and held under these conditions for the time noted below.

6. The pad is removed from the spinneret face to permit emergence of a filament.

The polymer of Run III is held at 180° C. for seven hours. Upon removing the pad, a filament emerges, part of which is wound up and analyzed for whiteness as described in Example 1. Found: 86L, μ0.8a, +7.9b, 35W. The filament appears white.

The polymer similar to the polymer of Run V-A is held at 180° C. for three hours. Upon removal of the pad from the spinneret, a foam strand emerges for a short time, but no solid filament is obtained even after strong quenching. The cylinder is cooled while under pressure. The polymer plug remaining in the cylinder is uniformly deep orange in color and has a foul odor including a strong smell of ammonia, suggesting severe polymer degradation and crosslinking during the three hours holding of the hydrate at 180° C., in contrast with the spinnability of the hydrate from the polymer of Run III even after seven hours at 180° C.

We claim:

1. In a process for spinning acrylonitrile polymer filaments comprising addition to the polymer of water in an amount equivalent as a minimum to either 45% of that required to hydrate all the nitrile groups in the polymer or 80% of that required to hydrate the coupled nitrile groups (on a 1/1 water molecule/nitrile group basis), whichever is larger, and as a maximum the amount of water actually combined as hydrate plus 7 weight percent based on polymer, the total water not exceeding the amount necessary to hydrate all the nitrile groups in the polymer, heating the composition under at least autogenous pressure at a temperature ranging between about 25° C. less to about 10° C. more than the temperature of hydration as determined by Laser Raman Spectroscopy and extrusion of the resulting composition under pressure through an orifice to form a shaped product, the improvement comprising use of an acrylonitrile polymer containing at least 91% by weight acrylonitrile units and up to 9% by weight of one or more copolymeric units, having an intrinsic of 0.6 to 2, 7 to 23 μeq./g. enolizable groups after mild acid treatment, 15 to 70μeq./g. thioether ends derived from a water insoluble mercaptan and less than 3 μeq./g. oxidizable hydrolysis fragments.

2. Process of claim 1 wherein the intrinsic viscosity is 0.8 to 1.5.

3. Process of claim 1 wherein the intrinsic viscosity is 0.9 to 1.1.

4. Process of claim 2 wherein the polymer has 30 to 50 μeq./g. thioether ends derived from a water insoluble mercaptan.

* * * * *